US011898776B2

(12) United States Patent
Derwinski et al.

(10) Patent No.: US 11,898,776 B2
(45) Date of Patent: Feb. 13, 2024

(54) ELEVATOR CAB AIR PURIFICATION

(71) Applicant: OTIS ELEVATOR COMPANY, Farmington, CT (US)

(72) Inventors: Patricia Derwinski, Farmington, CT (US); Cuauhtemoc Castro Inzunza, Florence, SC (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 377 days.

(21) Appl. No.: 16/994,884

(22) Filed: Aug. 17, 2020

(65) Prior Publication Data

US 2022/0049862 A1 Feb. 17, 2022

(51) Int. Cl.

| | |
|---|---|
| ***F24F 3/167*** | (2021.01) |
| ***F24F 8/192*** | (2021.01) |
| ***F24F 8/22*** | (2021.01) |
| ***F24F 7/003*** | (2021.01) |
| *F24F 7/007* | (2006.01) |

(52) U.S. Cl.

CPC ..... *F24F 8/22* (2021.01); *F24F 7/003* (2021.01); *F24F 3/167* (2021.01); *F24F 7/007* (2013.01); *F24F 8/192* (2021.01)

(58) Field of Classification Search

CPC .... F24F 3/167; F24F 8/192; F24F 8/22; F24F 7/007; F24F 7/003; F24F 13/167; B66B 11/024; B66B 11/0226

USPC ..... 454/187

See application file for complete search history.

(56) References Cited

U.S. PATENT DOCUMENTS 2,310,414 A * 2/1943 Fritzam ..... B66B 11/024 454/251
2,532,268 A * 11/1950 Christmann ..... B66B 11/024 62/429
3,103,708 A * 9/1963 Pomeroy ..... B66B 11/0253 52/28
3,252,400 A * 5/1966 Madl, Jr. ..... F24F 3/167 454/251
3,518,046 A * 6/1970 Cicirello ..... A61L 9/20 422/4

(Continued)

FOREIGN PATENT DOCUMENTS

CN 105923511 A * 9/2016
CN 105923511 A 9/2016

(Continued)

OTHER PUBLICATIONS

Extended European Search Report for Application No. EP 21 19 1534 dated Nov. 24, 2021.

*Primary Examiner* — Edelmira Bosques
*Assistant Examiner* — Frances F. Hamilton
(74) *Attorney, Agent, or Firm* — Carlson, Gaskey & Olds, P.C.

(57) ABSTRACT

An illustrative example embodiment of an elevator cab air purification device includes a housing having an inlet, an outlet, and at least one air pathway between the inlet and the outlet. A fan module is situated to cause air flow into the housing through the inlet, through the housing, and out of the housing through the outlet. The air flow through the housing includes air flow along the at least one pathway in at least a first direction. An air purifier is situated within the housing and configured to purify air that flows along the at least one pathway before the air exits the housing through the outlet.

11 Claims, 3 Drawing Sheets

(56) References Cited

U.S. PATENT DOCUMENTS 3,967,927 A * 7/1976 Patterson ..... F24F 3/14 422/121
5,225,167 A * 7/1993 Wetzel ..... F24F 8/22 250/492.1
6,631,589 B1 * 10/2003 Friedman ..... B66B 11/0226 187/401
7,005,111 B2 * 2/2006 Bollini ..... A61L 9/20 250/455.11
7,132,003 B2 * 11/2006 Hirayama ..... A61L 9/122 55/486
9,174,826 B1 * 11/2015 Nieves ..... E04B 2/7407
10,641,519 B1 * 5/2020 Freedman ..... F24F 1/0057
2004/0118094 A1 * 6/2004 Hirayama ..... F24F 8/108 55/472
2005/0145443 A1 * 7/2005 Friedman ..... B66B 11/0226 187/401
2005/0236013 A1 * 10/2005 Huston ..... B63J 2/04 134/1
2006/0070823 A1 * 4/2006 Huang ..... B66B 11/0233 187/401
2006/0213157 A1 * 9/2006 Kalous ..... F24F 8/158 55/385.2
2007/0181380 A1 * 8/2007 Bostock ..... B66B 11/0253 187/401
2009/0038473 A1 * 2/2009 Kwon ..... B03C 3/68 95/3
2010/0024459 A1 * 2/2010 Dillon ..... F24F 1/005 29/700
2010/0032589 A1 * 2/2010 Leben ..... A61L 2/10 250/504 R
2011/0006216 A1 * 1/2011 Searle ..... F24F 8/167 250/455.11
2011/0058372 A1 * 3/2011 Lerman ..... F21V 19/005 362/249.02
2013/0239803 A1 * 9/2013 Palmer ..... F24F 11/64 422/4
2014/0305749 A1 * 10/2014 Manner ..... B66B 11/0226 187/401
2016/0304319 A1 * 10/2016 Gebhardt ..... E04B 2/88
2017/0276395 A1 * 9/2017 Nyhof ..... F24F 1/005
2018/0037440 A1 * 2/2018 Blondel ..... B66B 11/0233
2018/0111797 A1 * 4/2018 Fauconnet ..... B66B 11/0226
2018/0156481 A1 * 6/2018 Carpenter ..... F24F 7/08
2018/0282127 A1 * 10/2018 Fauconnet ..... F16B 5/0208
2020/0196413 A1 * 6/2020 Ellis ..... H05B 45/335
2021/0395044 A1 * 12/2021 Lee ..... B08B 5/02
2022/0040354 A1 * 2/2022 Magee ..... A61L 9/22
2022/0048738 A1 * 2/2022 Derwinski ..... B66B 11/024

FOREIGN PATENT DOCUMENTS

CN 107720498 A * 2/2018
IT 201700103209 A1 3/2019
KR 20070096412 A * 10/2007
KR 100789954 B1 * 1/2008
KR 20100088386 A * 8/2010
KR 20110077804 A * 12/2019 ..... F24F 8/22

* cited by examiner

ELEVATOR CAB AIR PURIFICATION

BACKGROUND

Elevator systems typically include a cab for carrying passengers among various levels within a building. Many elevator cabs include a device for exchanging air between the interior of the cab and the hoistway. Such devices typically are limited in the amount of air flow or exchange that can be achieved. The limited air circulation provided by such devices and the unconditioned hoistway air typically inhibit such devices from easily addressing concerns about the purity of air in an elevator cab.

SUMMARY

An illustrative example embodiment of an elevator cab air purification device includes a housing having an inlet, an outlet, and at least one air pathway between the inlet and the outlet. A fan module is situated to cause air flow into the housing through the inlet, through the housing, and out of the housing through the outlet. The air flow through the housing includes air flow along the at least one pathway in at least a first direction. An air purifier is situated within the housing and configured to purify air that flows along the at least one pathway before the air exits the housing through the outlet.

In an example embodiment having at least one feature of the device of the previous paragraph, the air purifier comprises a source of radiation.

In an example embodiment having at least one feature of the device of the any of the previous paragraphs, the source of radiation comprises a light that emits ultraviolet light.

In an example embodiment having at least one feature of the device of the any of the previous paragraphs, the at least one pathway includes a plurality of pathways, airflow along at least one of the pathways is in a second direction that is different than the first direction, and each of the pathways includes the source of radiation along at least portion of a length of the pathway.

In an example embodiment having at least one feature of the device of the any of the previous paragraphs, the first direction is opposite the second direction.

In an example embodiment having at least one feature of the device of the any of the previous paragraphs, the elevator cab includes a plurality of vertically oriented walls between a floor and a ceiling, the housing is situated parallel to and against at least one of the walls, the first direction corresponds to air flow away from the ceiling and toward the floor, and the second direction corresponds to air flow away from the floor and toward the ceiling.

In an example embodiment having at least one feature of the device of the any of the previous paragraphs, the housing includes a plurality of baffles that define the pathways within the housing.

In an example embodiment having at least one feature of the device of the any of the previous paragraphs, the fan module comprises a plurality of fans, and at least one of the plurality of fans is situated in a different location of the housing than at least one others of the plurality of fans.

In an example embodiment having at least one feature of the device of the any of the previous paragraphs, the housing is configured to be situated against a corner of an interior of the elevator cab.

In an example embodiment having at least one feature of the device of the any of the previous paragraphs, the housing is configured as a portion of an interior cab wall, a raised panel or a cabinet.

An illustrative example embodiment of a method of purifying air in an elevator cab uses a housing having an inlet, an outlet, and at least one air pathway between the inlet and the outlet. The method includes: causing air flow into the housing through the inlet, through the housing, and out of the housing through the outlet, wherein the air flow through the housing includes air flow along the at least one pathway in at least a first direction; and purifying air that flows along the at least one pathway before the air exits the housing through the outlet.

In an example embodiment having at least one feature of the method of the previous paragraphs, purifying the air comprises irradiating the air.

In an example embodiment having at least one feature of the method of the any of the previous paragraphs, irradiating the air comprises exposing the air to ultraviolet light.

In an example embodiment having at least one feature of the method of the any of the previous paragraphs, the at least one pathway comprises a plurality of pathways, airflow along at least one other of the pathways is in a second direction different from the first direction, and irradiating the air comprises exposing the air flow along each of the pathways to a light that emits the radiation along at least portion of a length of the pathway.

In an example embodiment having at least one feature of the method of the any of the previous paragraphs, the first direction is opposite the second direction.

In an example embodiment having at least one feature of the method of the any of the previous paragraphs, the elevator cab includes a plurality of vertically oriented walls between a floor and a ceiling, the housing is situated parallel to and against at least one of the walls, the first direction corresponds to air flow away from the ceiling and toward the floor, and the second direction corresponds to air flow away from the floor and toward the ceiling.

In an example embodiment having at least one feature of the method of the any of the previous paragraphs, the housing includes a plurality of baffles that define the pathways within the housing.

In an example embodiment having at least one feature of the method of the any of the previous paragraphs, causing the air flow comprises using a fan module, the fan module comprises a plurality of fans, and at least one of the plurality of fans is situated in a different location of the housing than at least one others of the plurality of fans.

In an example embodiment having at least one feature of the method of the any of the previous paragraphs, the housing is configured to be situated against a corner of an interior of the elevator cab.

In an example embodiment having at least one feature of the method of the any of the previous paragraphs, the housing is configured as a portion of an interior cab wall, a raised panel or a cabinet.

The various features and advantages of at least one disclosed example embodiment will become apparent to those skilled in the art from the following detailed description. The drawings that accompany the detailed description can be briefly described as follows.

DETAILED DESCRIPTION

Figure 1:
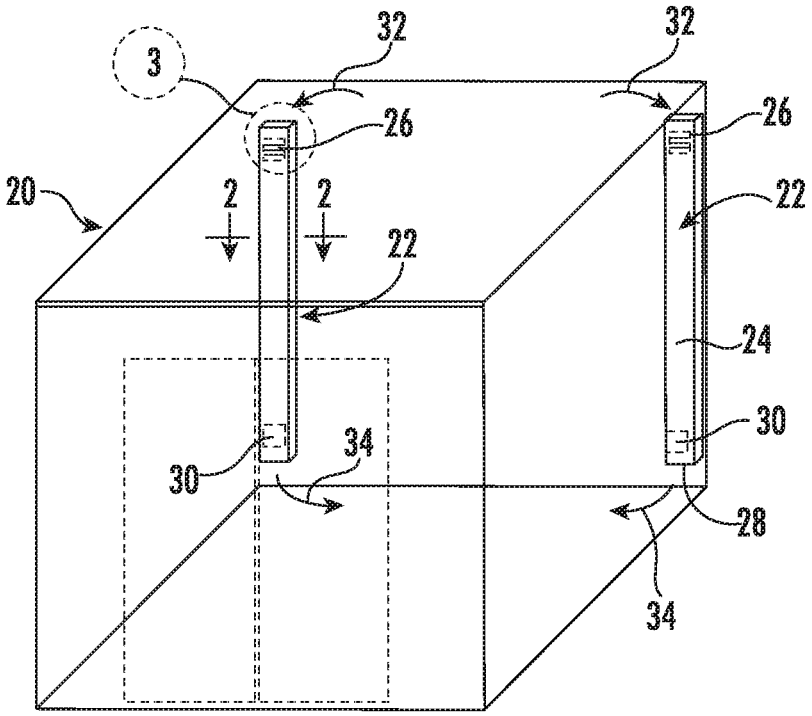
FIG. 1 diagrammatically illustrates selected portions of an example embodiment of an elevator cab including an example air purification device configuration.

FIG. 1 diagrammatically illustrates selected portions of an elevator cab 20. A plurality of air purification devices 22 are situated within the elevator cab 20. Each of the exemplary air purification devices 22 includes a housing 24 having an inlet 26 and an outlet 28. A fan module 30 causes airflow into the inlet 26, through a plurality of pathways within the housing 24 and out of the housing 24 through the outlet 28. The illustrated position of the fan module shown in FIG. 1 is for ease of illustration and not limiting in any way. The fan module 30 includes at least one fan. Multiple fans may be positioned in different locations along the housing 24 to achieve a desired airflow.

In the example of FIG. 1, air is drawn into the inlet 26 from near a ceiling of the elevator cab 22 as schematically represented by the arrows 32. Airflow exiting the outlet 28 is directed generally toward a floor of the elevator cab 20 as schematically shown by the arrows 34. In this example, the inlet 26 is located near the ceiling of the elevator cab 20 and the outlet 28 is located near the floor of the elevator cab 20 to take advantage of natural air convection within the elevator cab 20.

Figure 2:
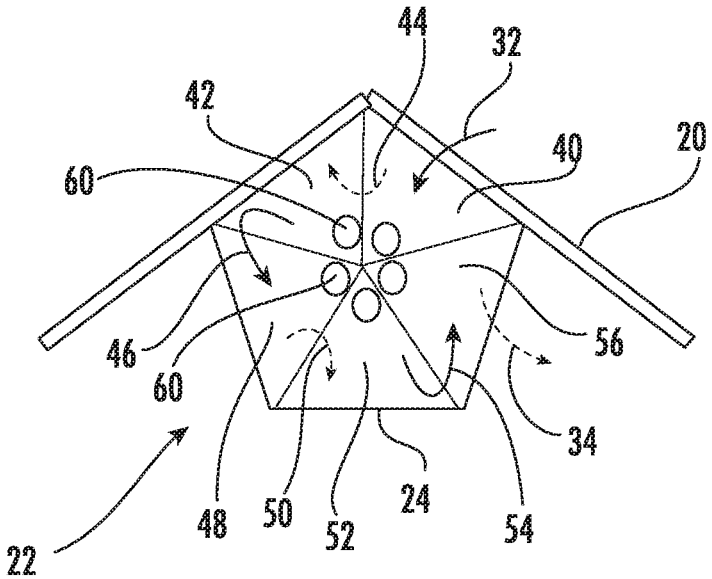
FIG. 2 is a cross-sectional illustration taken along the lines 2-2 in FIG. 1.

As can be appreciated from FIGS. 1 and 2, the air purification devices 22 in this example embodiment are configured to be received in a corner of the interior of the elevator cab 20. The housings 24 in this example include two sides configured to be received against and secured to the two walls that meet at the corresponding corner of the elevator cab 20. Other embodiments, such as that shown in FIG. 5, include housings that are configured to be situated along and secured to a wall of the elevator cab 20. The number and size of air purification devices 22 may vary to achieve sufficient purification for a particular cab size or expected occupancy during use.

In FIG. 2, the airflow arrows that are in broken lines represent airflow near a bottom of the housing 24 and the solid-line arrows represents airflow near a top of the housing 24. In this example embodiment, the housing includes a first pathway 40 extending from the inlet 26 toward a bottom of the housing 24. The air moves downward along the first pathway 40 in a downward direction (e.g., into the page in FIG. 2). Airflow leaves the first pathway 40 and continues along a second pathway 42 as schematically represented by the arrow 44. Airflow through the second pathway 42 is in an upward direction (e.g., out of the page according to FIG. 2).

The airflow continues as shown at 46 from the second pathway 42 into a third pathway 48. In this example, the air flows downward through the third pathway 48 and eventually transitions as shown by the arrow 50 into a fourth pathway 52. Airflow through the fourth pathway 52 is in an upward direction. The airflow eventually transitions as represented by the arrow 54 into a fifth pathway 56 from which it eventually exits the housing 24 through the outlet 28 as represented by the arrow 34.

Each of the pathways 40, 42, 48, 52 and 56 includes an air purifier that may comprise various features or components, such as a filter or a source of radiation. For purposes of discussion, the illustrated example embodiments include a source of radiation 60 as the air purifier. The source of radiation 60 irradiates the air flowing along the pathway. The sources of radiation 60 are situated to irradiate the air within each pathway to purify the air. According to this description, purified air has at least some contaminants removed from it. Air is purified even if less than all particles or contaminants are removed from the air. In other words, purified air is not necessarily absolutely pure but has a lower level of concentration of at least one type of contaminant compared to air that has not been purified by the purification device 22.

In an example embodiment, the sources of radiation 60 emit ultraviolet light so that air flowing along each pathway is irradiated by the ultraviolet radiation. In some embodiments, the sources of ultraviolet light include a plurality of light emitting diodes (LEDs). In an example embodiment, a flexible ribbon made of a silicone material supports a plurality of LEDs that emit ultraviolet light along the corresponding pathway within the housing 24. A silicone-based support for the LEDs is not subject to ultraviolet degradation and provides a small packaging envelope so that a useful amount of ultraviolet radiation affects the airflow in each passageway without requiring the air purification device 22 to take up a significant amount of space within the interior of the elevator cab 20.

The housing 24 retains the ultraviolet light or other purifying radiation and prevents it from emanating into the interior of the elevator cab. Only the air flowing along the pathways of the air purification device 22 is exposed to that radiation.

Figure 3:
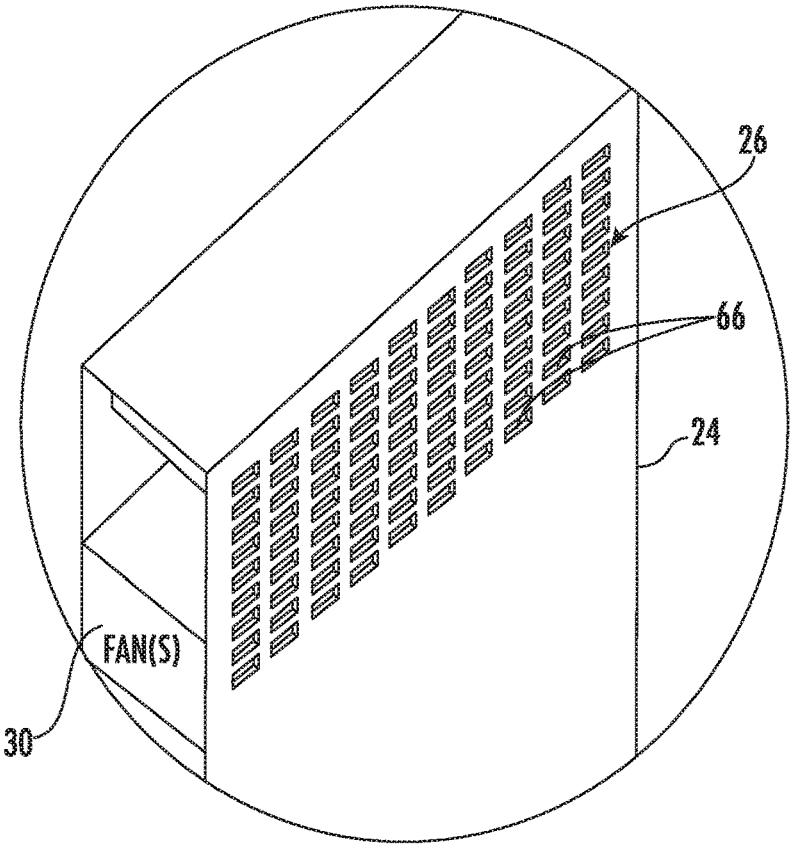
FIG. 3 is an amplified view of the portion of FIG. 1 encircled at 3.
Figure 4:
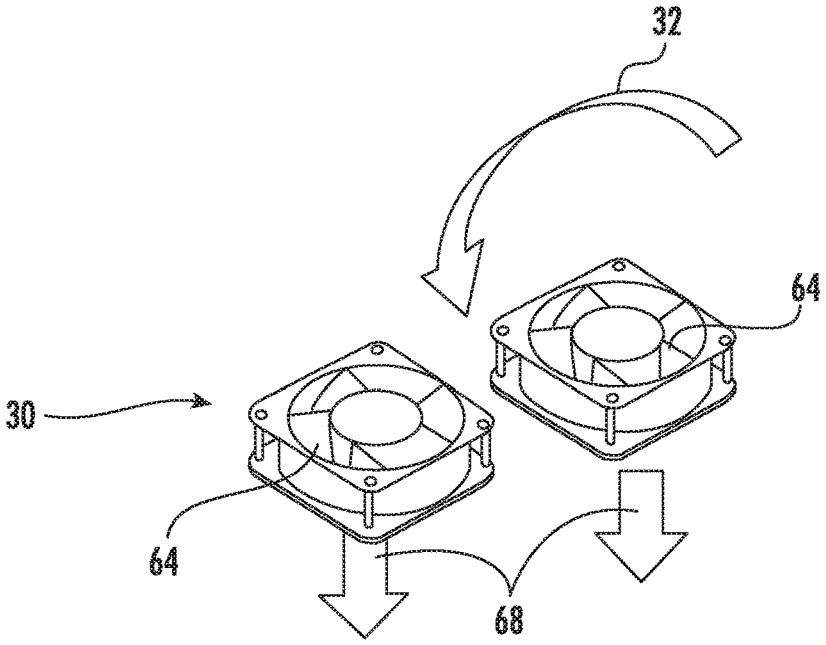
FIG. 4 diagrammatically illustrates selected portions of a fan module.

FIGS. 3 and 4 show an example configuration of a fan module 30. In this example, the fan module includes a plurality of fans 64 that draw air in through louver openings 66 of the inlet 26. The fans 64 then propel air or cause airflow as represented by the arrows 68 into at least one pathway within the housing 24. Other embodiments include a single fan that is capable of establishing the desired airflow throughout the entire air purification device 22.

Figure 5:
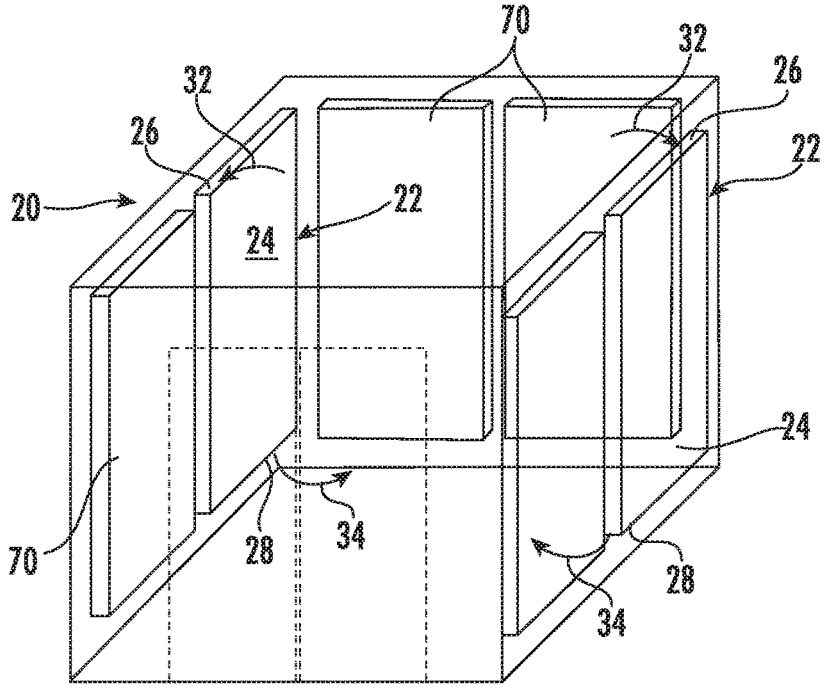
FIG. 5 diagrammatically illustrates another example embodiment of an elevator cab including an example air purification device configuration.
Figure 6:
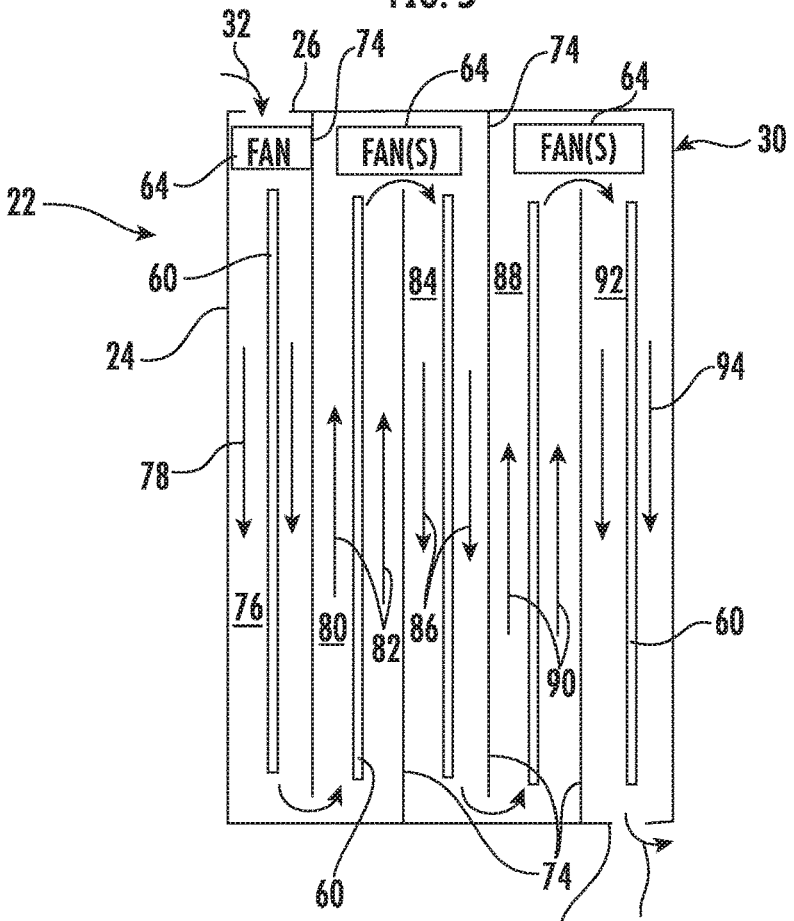
FIG. 6 schematically illustrates selected features of the air purification device configuration included in FIG. 5.

FIGS. 5 and 6 illustrate another example embodiment. Raised panels 70 are provided for aesthetic purposes within the interior of the elevator cab 20. The air purification devices 22 in this example are configured to appear like raised panels, resembling the aesthetic raised panels 70. The housing 24 is configured as a raised panel or a relatively thin cabinet that is supported on a wall of the elevator cab 20. In this example, a plurality of baffles 74 are situated within the housing 24 to establish a plurality of airflow pathways.

As shown in FIG. 6, the fan module 30 includes multiple fans 64. At least one of the fans 64 draws air into the inlet 26 and causes airflow along a first pathway 76 as represented by the arrows 78. A source of radiation 60, such as a strip of LEDs is situated along a substantial portion of the length of the pathway 76 for irradiating the air flowing along the pathway 76.

The first pathway 76 in this example ends near a bottom of the housing 24 where the airflow continues around an end of the corresponding baffle 74 into a second pathway 80 that includes its own source of radiation 60. As represented by the arrows 82, the airflow through the second pathway 80 in this example is in an upward direction away from the floor of the elevator cab and toward the ceiling of the elevator cab.

A third pathway 84 receives continued airflow that moves through the third pathway 84 in a downward direction as directed by the arrows 86. A fourth pathway 88 accommodates airflow as represented by the arrows 90 and a fifth pathway 92 accommodates airflow as represented by the arrows 94 toward the outlet 28 where the purified air exists the housing 24 as represented by the arrow 34.

The fans 64 of the fan module 30 are situated at various locations of the housing 24 in this example to achieve a desired air flow rate through the pathways. The fans 64 operate to establish a flow rate that ensures a desired amount of time that the air is exposed to the ultraviolet radiation to reduce or eliminate contaminants or pathogens in the air. In the illustrated example embodiments, the plurality of pathways and the different directions of airflow along those pathways provides a substantial enough time of exposure of the air to the ultraviolet radiation for effectively purifying the air flowing through the housing 24. In the illustrated example embodiments, the air purification devices 24 are taller than they are wide and, therefore, the airflow pathways are oriented in a vertical direction and the airflow is directed vertically between the ceiling and the floor in opposite directions along adjacent pathways.

In other embodiments, a serpentine arrangement of pathways in a generally horizontal orientation within a housing 24 accommodates airflow for a sufficient amount of time to provide adequate exposure to ultraviolet radiation for purifying the air.

The embodiments described above can be retrofit into existing elevator cabs without disrupting the aesthetic of the interior of the cab. Those and other embodiments are useful for new cabs or fully renovated cab interiors. Some embodiments intended to be incorporated into a new cab or new cab interior include a housing that extends from the decorative ceiling area to the kickplate area. The air purification device is embedded into the exterior of the shell, in a fashion similar to arrangement of the embodiment shown in FIGS. 5 and 6. The air purification device of such embodiments is embedded into the shell panel, itself.

Air purification devices 22 like those in the disclosed example embodiments, facilitate purifying air within an elevator cab 20. Such devices are useful, for example to reduce or eliminate airborne pathogens or contaminants, such as the COVID-19 virus or other communicable diseases. The air purification devices 22 fit within an elevator cab 20 in a manner that does not reduce the passenger-carrying capacity in most instances. The air purification devices 22 can be incorporated into the interior of an elevator cab 20 without disrupting the aesthetics of the cab interior.

The preceding description is exemplary rather than limiting in nature. Variations and modifications to the disclosed examples may become apparent to those skilled in the art that do not necessarily depart from the essence of this invention. The scope of legal protection given to this invention can only be determined by studying the following claims.

We claim:

1. An elevator cab air purification device, comprising:

a housing including an inlet, an outlet, and a plurality of air pathways between the inlet and the outlet;

a fan module that is situated to cause air flow into the housing through the inlet, through the housing, and out of the housing through the outlet, wherein the air flow through the housing includes air flow along at least one of the plurality of air pathways in a first direction and air flow along at least one other of the plurality of air pathways in a second direction that is opposite the first direction;

an air purifier comprising at least one source of radiation situated within the housing along a substantial length of the plurality of air pathways and configured to purify air that flows along the plurality of air pathways to thereby purify the air before the air exits the housing through the outlet, wherein an elevator cab includes a plurality of vertically oriented walls between a floor and a ceiling, the elevator cab has a plurality of aesthetic raised panels on the plurality of vertically oriented walls and the housing is configured as one of the plurality of aesthetic raised panels, and the housing is situated parallel to and against at least one of the plurality of vertically oriented walls along a substantial portion of a distance between the floor and the ceiling;

wherein the housing includes a plurality of baffles that define the plurality of air pathways within the housing, and wherein the plurality of baffles are spaced apart from each other in a direction across a width of the at least one of the plurality of vertically oriented walls such that the plurality of air pathways comprise a series of vertical air pathways that each extend along the substantial portion of the distance between the floor and the ceiling;

wherein the fan module comprises a plurality of fans, and wherein the series of vertical air pathways comprise at least five vertical air pathways; and wherein a first fan of the plurality of fans is located in a first vertical air pathway of the at least five vertical air pathways adjacent to the inlet; and a second fan of the plurality of fans is located in a transition between a second vertical air pathway and a third vertical air pathway of the at least five vertical air pathways; and a third fan of the plurality of fans is located in a transition between a fourth vertical air pathway and a fifth vertical air pathway of the at least five vertical air pathways.

2. The device of claim 1, wherein the at least one source of radiation comprises a strip of lights that emit ultraviolet light, and each strip of lights extends along a substantial length of each air pathway.

3. The device of claim 1, wherein the first direction corresponds to air flow away from the ceiling and toward the floor, and the second direction corresponds to air flow away from the floor and toward the ceiling.

4. The device of claim 1, wherein the at least one of the plurality of vertically oriented walls includes a pair of aesthetic raised panels from the plurality of aesthetic raised panels, and wherein the housing comprises at least one aesthetic raised panel from the pair of aesthetic raised panel, and wherein the distance between the floor and the ceiling for the at least one of the plurality of vertically oriented walls comprises a wall height and wherein the at least one of the plurality of vertically oriented walls has the wall width, and wherein the pair of aesthetic raised panels is situated along a substantial portion of the wall width.

5. A method of purifying air in an elevator cab using a housing including an inlet, an outlet, and a plurality of air pathways between the inlet and the outlet, wherein the elevator cab includes a plurality of vertically oriented walls between a floor and a ceiling, the housing is situated parallel to and against at least one of the plurality of vertically oriented walls along a substantial portion of a distance between the floor and the ceiling, the method comprising:

causing air flow into the housing through the inlet, through the housing, and out of the housing through the outlet, wherein the air flow through the housing includes air flow along one of the plurality of air pathways in a first direction and air flow along another one of the plurality of air pathways in a second direction that is opposite the first direction, and wherein causing the air flow comprises using a fan module comprising a plurality of fans; and purifying air that flows along the plurality of air pathways by irradiating the air along a substantial length of the plurality of air pathways, respectively, before the air exits the housing through the outlet, and wherein air is purified via an air purifier comprising a radiation strip that extends from a first end of one of the air pathways adjacent a fan of the plurality of fans at the inlet and towards a second end of the one of the air pathways adjacent the outlet: and wherein the elevator cab has a plurality of aesthetic raised panels on the plurality of vertically oriented walls and the housing is configured as one of the plurality of aesthetic raised panels;

wherein the housing includes a plurality of baffles that define the plurality of air pathways within the housing, and wherein the plurality of baffles are spaced apart from each other in a direction across a width of the at least one of the plurality of vertically oriented walls such that the plurality of air pathways comprise a series of vertical air pathways that each extend along the substantial portion of the distance between the floor and the ceiling, and wherein the series of vertical air pathways comprise at least five vertical air pathways, and wherein:

a first fan of the plurality of fans is located in a first vertical air pathway of the at least five vertical air pathways adjacent to the inlet:

a second fan of the plurality of fans is located in a transition between a second vertical air pathway and a third vertical air pathway of the at least five vertical air pathways;

wherein the fan module comprises the first fan of the plurality of fans that is situated in the first vertical air pathway of the series of vertical air pathways;

the second fan of the plurality of fans is situated in the second vertical air pathway of the series of vertical air pathways: and a third fan of the plurality of fans is located in a transition between a fourth vertical air pathway and a fifth vertical air pathway of the at least five vertical air pathways.

6. The method of claim 5, wherein irradiating the air comprises exposing the air to ultraviolet light, and wherein the radiation strip comprises a flexible ribbon made of a silicone material that supports a plurality of LEDs that emit ultraviolet light along a corresponding pathway.

7. The method of claim 5, wherein the first direction corresponds to air flow away from the ceiling and toward the floor, and the second direction corresponds to air flow away from the floor and toward the ceiling.

8. The method of claim 5, wherein the at least one of the plurality of vertically oriented walls includes a pair of aesthetic raised panels from the plurality of aesthetic raised panels, and wherein the housing comprises at least one aesthetic raised panel from the pair of aesthetic raised panel, and wherein the distance between the floor and the ceiling for the at least one of the plurality of vertically oriented walls comprises a wall height and wherein the at least one of the plurality of vertically oriented walls has the wall width, and wherein the pair of aesthetic raised panels is situated along a substantial portion of the wall width.

9. An elevator cab, comprising:

a floor;

a ceiling;

a plurality of vertically oriented walls between the floor and the ceiling, at least one of the plurality of vertically oriented walls including a plurality of aesthetic raised panels each having a height that extends over a substantial portion of a distance between the floor and the ceiling, a housing being configured as at least one of the plurality of aesthetic raised panels, the housing including an inlet, an outlet, and a plurality of air pathways between the inlet and the outlet;

a fan module that is situated to cause air flow into the inlet and along at least one of the plurality of air pathways in a first direction and air flow along at least one other of the plurality of air pathways in a second direction that is opposite the first direction; and an air purifier comprising at least one source of radiation situated within the plurality of air pathways along a substantial length of the plurality of air pathways and configured to irradiate air that flows along the plurality of air pathways to thereby purify the air before the air exits the outlet, and wherein the at least one source of radiation comprises a radiation strip that extends from a first end adjacent a fan from the fan module at the inlet to a second end adjacent the outlet;

wherein the housing, configured as the at least one of the plurality of aesthetic raised panels, includes a plurality of baffles that define the plurality of air pathways, and wherein the plurality of baffles are spaced apart from each other in a direction across a width of the at least one of the plurality of vertically oriented walls such that the plurality of air pathways comprise a series of vertical air pathways that each extend along the substantial portion of the distance between the floor and the ceiling;

wherein the fan module comprises a plurality of fans, and wherein the series of vertical air pathways comprise at least five vertical air pathways, and wherein:

the fan module comprises:

a first fan of the plurality of fans located in a first vertical air pathway of the at least five vertical air pathways adjacent to the inlet;

a second fan of the plurality of fans located in a transition between a second vertical air pathway and a third vertical air pathway of the at least five vertical air pathways; and a third fan of the plurality of fans located in a transition between a fourth vertical air pathway and a fifth vertical air pathway of the at least five vertical air pathways.

10. The elevator cab of claim 9, wherein the first direction is from the floor to the ceiling and the second direction is from the ceiling to the floor.

11. The elevator cab of claim 9, wherein each radiation strip extends along a substantial length of each air pathway, and wherein the radiation strip comprises a flexible ribbon made of a silicone material that supports a plurality of LEDs that emit ultraviolet light along a corresponding pathway.

* * * * *